US010188216B2

(12) United States Patent
Gatrill

(10) Patent No.: US 10,188,216 B2
(45) Date of Patent: Jan. 29, 2019

(54) CONVERTIBLE CASE AND STOOL

(71) Applicant: Adrian Gatrill, Vancouver (CA)

(72) Inventor: Adrian Gatrill, Vancouver (CA)

( * ) Notice: Subject to any disclaimer, the term of this patent is extended or adjusted under 35 U.S.C. 154(b) by 322 days.

(21) Appl. No.: 14/927,249

(22) Filed: Oct. 29, 2015

(65) Prior Publication Data

US 2017/0119163 A1 May 4, 2017

(51) Int. Cl.

| | |
|---|---|
| ***A47C 9/10*** | (2006.01) |
| ***A47C 13/00*** | (2006.01) |
| ***A45C 9/00*** | (2006.01) |
| ***A47B 23/00*** | (2006.01) |
| ***B65D 25/28*** | (2006.01) |
| ***B65D 81/36*** | (2006.01) |
| ***A47C 4/52*** | (2006.01) |
| ***A45C 5/03*** | (2006.01) |
| ***A45C 13/10*** | (2006.01) |
| ***A45C 13/12*** | (2006.01) |
| *A45C 13/14* | (2006.01) |

(52) U.S. Cl.

CPC ..... *A47C 9/10* (2013.01); *A45C 5/03* (2013.01); *A45C 9/00* (2013.01); *A45C 13/1076* (2013.01); *A45C 13/12* (2013.01); *A47B 23/001* (2013.01); *A47B 23/002* (2013.01); *A47C 4/52* (2013.01); *A47C 13/00* (2013.01); *B65D 25/28* (2013.01); *B65D 81/36* (2013.01); *A45C 13/14* (2013.01); *A45C 2009/002* (2013.01)

(58) Field of Classification Search

CPC ..... A47C 9/10; A47C 16/00; A47C 16/02; A47C 13/00; A47C 7/002; A47C 4/021; A47B 23/001; A45C 2007/0004; A45C 2009/002

See application file for complete search history.

(56) References Cited

U.S. PATENT DOCUMENTS 1,457,041 A 5/1923 Orear
1,982,295 A * 11/1934 Gurback ..... A47C 4/283 108/128
2,372,077 A 3/1945 Glinecki
(Continued)

FOREIGN PATENT DOCUMENTS

CN 204015504 U 12/2014
ES 2359998 5/2011
(Continued)

OTHER PUBLICATIONS

Search Report dated Mar. 17, 2017 issued by the United Kingdom Intellectual Property Office on corresponding application No. GB1618231.3.

*Primary Examiner* — Timothy J Brindley

(74) *Attorney, Agent, or Firm* — Oyen Wiggs Green & Mutala LLP

(57) ABSTRACT

A case that is convertible into a stool and a working surface is provided. The case includes a worktable, a front panel removably secured to a front side of the worktable, and a rear panel removably secured to a rear side of the worktable. The front and rear panels each include a slot inwardly extending from a first edge thereof. The front and rear panels may be removed from the worktable and interconnected by sliding the slot of the front panel through the slot of the rear panel. The stool seat is removably attachable to the case and/or to the interconnected panels to form a stool.

22 Claims, 11 Drawing Sheets

(56) References Cited

U.S. PATENT DOCUMENTS

| | | | | | |
|---|---|---|---|---|---|
| 2,375,819 | A * | 5/1945 | Reid | A47C 9/10 | 108/115 |
| 2,792,877 | A | 5/1957 | West | | |
| 3,128,137 | A | 4/1964 | Dokter | | |
| 3,338,189 | A * | 8/1967 | Xavier | A47C 4/021 | 108/159 |
| 3,399,925 | A | 9/1968 | Levy | | |
| 3,788,700 | A | 1/1974 | Wartes | | |
| 3,841,727 | A | 10/1974 | Peng | | |
| 4,076,348 | A | 2/1978 | Allison | | |
| 4,188,067 | A | 2/1980 | Elmer | | |
| 4,190,001 | A * | 2/1980 | Cecala | A47B 13/04 | 108/161 |
| 4,387,924 | A * | 6/1983 | Fernandez | A45C 15/00 | 224/155 |
| 4,700,914 | A * | 10/1987 | Cheetham | A47C 9/10 | 108/150 |
| 5,251,955 | A | 10/1993 | Sarafa | | |
| 5,615,621 | A * | 4/1997 | Mengshoel | A47B 13/02 | 108/101 |
| 5,644,995 | A * | 7/1997 | Gurwell | A47B 3/12 | 108/158.12 |
| 6,631,957 | B2 | 10/2003 | Leong | | |
| 6,986,445 | B1 * | 1/2006 | Stockman | A45F 4/02 | 224/155 |
| 7,347,430 | B2 | 3/2008 | Jenkins | | |
| 7,533,940 | B1 | 5/2009 | Zook | | |
| 7,905,184 | B2 * | 3/2011 | Eveleth | A47B 3/08 | 108/115 |
| 8,661,991 | B2 * | 3/2014 | Eveleth | A47B 3/08 | 108/115 |
| 9,062,819 | B1 * | 6/2015 | Chen | F16M 13/04 | |
| 2002/0063463 | A1 * | 5/2002 | Leong | A47C 4/021 | 297/440.12 |
| 2003/0107254 | A1 * | 6/2003 | Willy | A47B 3/06 | 297/440.13 |
| 2009/0102248 | A1 * | 4/2009 | Grace | A47C 4/283 | 297/16.2 |
| 2011/0001340 | A1 * | 1/2011 | Bannister | A47C 9/02 | 297/217.1 |
| 2011/0254240 | A1 * | 10/2011 | Hurt | A47C 7/006 | 280/32.5 |
| 2014/0165289 | A1 * | 6/2014 | Trocchia | A47D 1/006 | 5/131 |
| 2014/0373357 | A1 * | 12/2014 | Elliott | B23P 11/00 | 29/897 |
| 2015/0076871 | A1 * | 3/2015 | Werner | A47C 9/10 | 297/135 |
| 2015/0296986 | A1 * | 10/2015 | Rogers | A47C 1/124 | 297/239 |
| 2016/0000226 | A1 * | 1/2016 | Sanza Pilas | A47C 4/52 | 297/4 |
| 2016/0309662 | A1 * | 10/2016 | Green | A47C 4/021 | |
| 2017/0280868 | A1 * | 10/2017 | Campbell, Jr. | A47B 23/06 | |
| 2017/0314728 | A1 * | 11/2017 | Grisham | F16M 11/24 | |

FOREIGN PATENT DOCUMENTS

| | | |
|---|---|---|
| FR | 340209 | 6/1904 |
| GB | 264649 | 1/1927 |

* cited by examiner

CONVERTIBLE CASE AND STOOL

TECHNICAL FIELD

Some embodiments of the present invention relate to portable workstations. In particular, some embodiments of the present invention relate to portable cases that are convertible into a stool and a worktable.

BACKGROUND

Pochade boxes are compact boxes that allow a user to keep all of their tools in one location and enable a user to perform work on the inside lid of the box. These boxes are traditionally used for travel and outdoor artistic endeavors such as plein air painting. These boxes and other known portable workstations suffer from disadvantages. For example, such workstations are cumbersome to carry and/or lack a seat to sit on when the user is working in the field.

There is a general desire for a portable workstation that is readily convertible from a compact case, which is used to conveniently carry tools and equipment, into an easily assembled workstation that includes a stool to seat the user and a worktable to enable the user to perform work with comfort and convenience.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools, and methods which are meant to be exemplary and illustrative, not limiting in scope. In various embodiments, one or more of the above-described problems have been reduced or eliminated, while other embodiments are directed to other improvements.

The present invention has a number of aspects. One aspect of the present invention provides a carrying case that is convertible into a stool and a working surface. The case includes a worktable, a front panel removably secured to a front side of the worktable, a rear panel removably secured to a rear surface of the worktable, and a stool seat. The front and rear panels are removable from the worktable and interconnectable to form a supporting substructure of the stool. The stool seat is removably attachable to the substructure.

In some embodiments, the front and rear panels each include a slot inwardly extending from a first edge thereof. The front and rear panels may be interconnected by sliding the slot of the front panel through the slot of the rear panel to form the substructure of the stool.

In some embodiments, the stool seat has a front end removably attachable to the front panel and/or a rear end removably attachable to the rear panel.

In some embodiments, the stool seat includes at least one front end fastener positioned adjacent to the front end of the stool seat and/or at least one rear end fastener positioned adjacent to the rear end of the stool seat.

In some embodiments, the front and rear panels each include at least one case fastener secured to a first surface thereof and positioned adjacent to an inward end of the slot. The at least one case fastener of the front panel may engage the at least one front end fastener of the stool seat and/or the at least one case fastener of the rear panel may engage the at least one rear end fastener of the stool seat when the front and rear panels are removably secured to the worktable.

In some embodiments, the front and rear panels each include at least one stool fastener secured to the first surface thereof and positioned adjacent to a second edge parallel to the slot. The at least one stool fastener of the front panel may engage the at least one front end fastener of the stool seat and/or the at least one stool fastener of the rear panel may engage the at least one rear end fastener of the stool seat when the front and rear panels are interconnected.

In some embodiments, the front and rear panels each include at least one stool fastener secured to a second surface thereof and positioned adjacent to a second edge parallel to the slot. The at least one stool fastener of the front panel may engage the at least one front end fastener of the stool seat and/or the at least one stool fastener of the rear panel may engage the at least one rear end fastener of the stool seat when the front and rear panels are interconnected.

In some embodiments, the stool seat includes a handle.

In some embodiments, the stool seat comprises a flexible sheet material.

In some embodiments, the stool seat comprises a hinged and/or an articulated rigid material.

In some embodiments, the case further includes at least one retaining clip attached to a bottom surface of the worktable for removably securing the front and rear panels to the worktable.

In some embodiments, the front panel and/or the rear panel includes a notch adjacent to a third edge thereof for engaging the at least one retaining clip.

In some embodiments, the front panel and/or the rear panel includes at least one worktable fastener for removably securing the respective panel to the worktable.

In some embodiments, the worktable includes at least one panel fastener for removably securing the front panel and/or the rear panel to the worktable.

In some embodiments, the worktable includes an inside panel, a top panel secured to a top edge of the inside panel, a bottom panel secured to a bottom edge of the inside panel opposed to the top edge, a first side panel secured to a first side edge of the inside panel, and a second side panel secured to a second side edge of the inside panel opposed to the first side edge.

In some embodiments, an inside surface of each of the top panel, the bottom panel, the first side panel, and the second side panel and a front surface of the inside panel form a first cavity.

In some embodiments, the inside surface of each of the top panel, the bottom panel, the first side panel, and the second side panel and a rear surface of the inside panel form a second cavity.

In some embodiments, the worktable is integrally formed.

In some embodiments, a front edge of the top panel extends outwardly from a front edge of the side panels and/or a rear edge of the top panel extends outwardly from a rear edge of the side panels. In some embodiments, a front edge of the bottom panel extends outwardly from a front edge of the side panels and/or a rear edge of the bottom panel extends outwardly from a rear edge of the side panels.

In some embodiments, opposed edges of the front and rear panels each include at least one tongue and an inside surface of each the top and bottom panels of the worktable each comprise at least one groove adjacent to both of the front and rear edges thereof. The at least one tongue of the front panel matingly engages the at least one groove of the top and bottom panels of the worktable adjacent to the front edge.

The at least one tongue of the rear panel matingly engages the at least one groove of the top and bottom panels of the worktable adjacent to the rear edge.

In some embodiments, opposed edges of the front and rear panels each include at least one groove and an inside surface of each the top and bottom panels of the worktable each comprise at least one tongue adjacent to both of the front and rear edges thereof. The at least one groove of the front panel matingly engages the at least one tongue of the top and bottom panels of the worktable adjacent to the front edge. The at least one groove of the rear panel matingly engages the at least one tongue of the top and bottom panels of the worktable adjacent to the rear edge.

Another aspect of the present invention provides a stool including a front panel having a slot inwardly extending from a first edge thereof, a rear panel having a slot inwardly extending from a first edge thereof, and a stool seat. The front and rear panels are interconnectable to form a supporting substructure of the stool by sliding the slot of the front panel through the slot of the rear panel. The stool seat is removably attachable to the substructure.

In some embodiments, the stool seat includes at least one front end fastener positioned adjacent to a front end thereof and/or at least one rear end fastener positioned adjacent to a rear end thereof.

In some embodiments, the front and rear panels each include at least one stool fastener secured to a first surface thereof and positioned adjacent to a first edge parallel to the slot. When the front and rear panels are interconnected to form the substructure, the at least one stool fastener of the front panel engages the at least one front end fastener of the stool seat and/or the at least one stool fastener of the rear panel engages the at least one rear end fastener of the stool seat.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
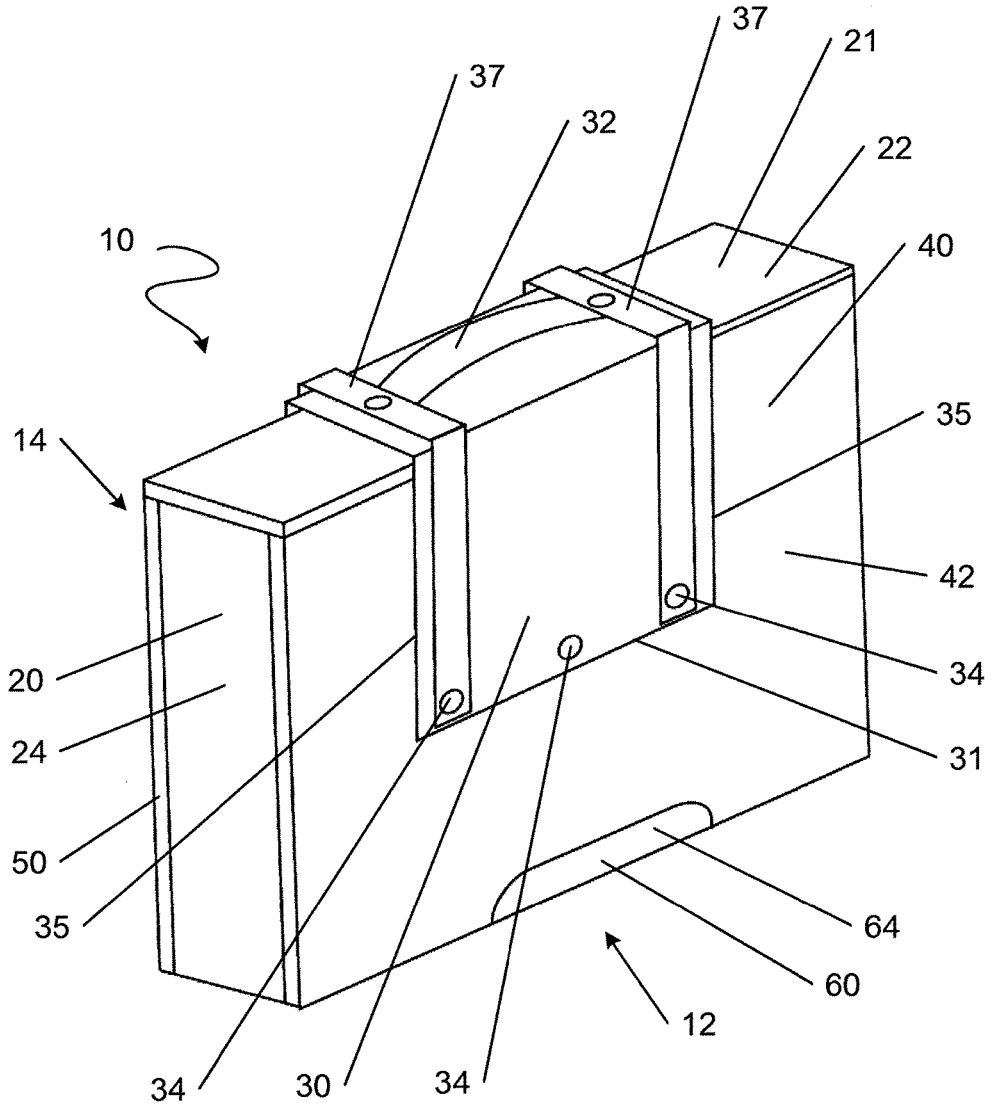
FIG. 1 is a perspective view of a convertible case according to an example embodiment of the present invention.

Unless context dictates otherwise, the term "carrying mode" (as used herein) means the state wherein a convertible case is fully assembled (for example, the state of the convertible case shown in FIG. 1).

A case 10 in accordance with one example embodiment of the present invention is shown in FIG. 1. Case 10 is convertible into a stool and a working surface. Case 10 includes a worktable 20, a stool seat 30, front panel 40 removably secured to a front side 12 of worktable 20, and a rear panel 50 removably secured to a rear side 14 of worktable 20. A front end 31 of stool seat 30 is removably attachable to front panel 40 and a rear end 33 (FIG. 2) of stool seat 30 is removably attachable to rear panel 50. In carrying mode, the front end 31 of stool seat 30 is removably attached to front panel 40. Stool seat 30 extends across a top surface 21 of worktable 20 and the rear end 33 of stool seat 30 is removably attached to rear panel 50. Stool seat 30 may include a handle 32 for carrying case 10 with comfort and convenience. In some embodiments, stool seat 30 is carried inside case 10 when case 10 is in carrying mode. Top surface 21 of worktable 20 of such embodiments may include a handle (FIGS. 8 and 9). In carrying mode, case 10 may resemble a briefcase.

Figure 2:
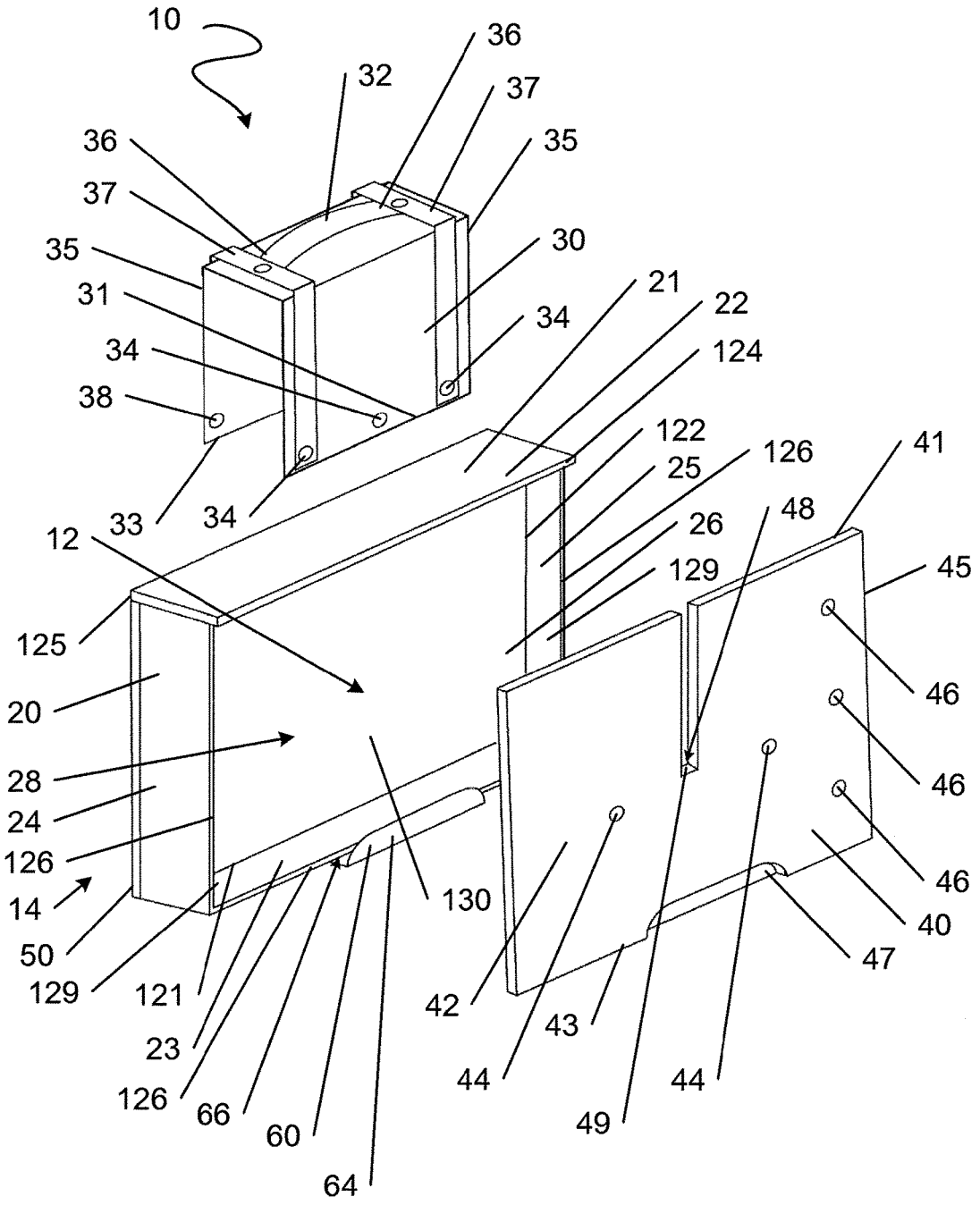
FIG. 2 is a perspective view of the convertible case according to the example embodiment shown in FIG. 1, wherein the case is partially disassembled.

Front and rear panels 40, 50 may be removed from worktable 20 to form a stool 100 (FIG. 3) that is structurally independent of worktable 20. In some embodiments, to remove front and rear panels 40, 50 from worktable 20, stool seat 30 is first removed from case 10. Panels 40, 50 may then be removed from worktable 20. FIG. 2 shows a partially disassembled case 10 wherein stool seat 30 and front panel 40 have been removed from case 10. As seen in FIG. 2, front panel 40 includes a slot 48 inwardly extending from a top edge 41 thereof. Rear panel 50 similarly includes a slot (not shown) inwardly extending from a top edge 51 thereof. In some embodiments, slot 48 (and/or the slot of rear panel 50) may alternatively extend inwardly from a bottom or side edge of the panel. Front and rear panels 40, 50 are interconnectable to form a supporting substructure 110 of stool 100 by inserting slot 48 of front panel 40 through the slot (not shown) of rear panel 50 such that panels 40, 50 intersect. Stool seat 30 is removably attached to substructure 110 to form the sitting surface of stool 100. Persons skilled in the art will recognize that front and rear panels 40, 50 may be removed from worktable 20 and used with or without stool seat 30 to form other types of furniture for sitting conventionally known.

Stool seat 30 is removably attached to front and rear panels 40, 50 using a variety of fastening means conventionally known. For example, front panel 40 includes at least one fastener 44 secured to an outside surface 42 thereof and positioned adjacent to an inward end 49 of slot 48. Front panel 40 further includes at least one fastener 46 secured to outside surface 42 and positioned adjacent to a side edge 45 thereof. In the example embodiment shown in FIG. 2, two fasteners 44 and three fasteners 46 are shown secured to outside surface 42 of front panel 40. Each fastener 44 is positioned an equal distance from top edge 41. Each fastener 46 is positioned an equal distance from side edge 45. Persons skilled in the art will recognize that any reasonable number of fasteners 44, 46 may be used to attach stool seat 30 to front panel 40. At least one fastener 44 and/or at least one fastener 46 may be attached to front panel 40 and/or formed integrally therewith. For example, at least one fastener 44 and/or at least one fastener 46 may comprise one or more of snaps (i.e. press studs), Velcro™, buckles, hooks, toggles, keder rails, magnets, or other fastening devices conventionally known. In some embodiments, at least one fastener 44 is attached to or integrally formed with outside surface 42 of front panel 40 and at least one fastener 46 is attached to or integrally formed with an inside surface (not shown) of front panel 40. In this way, at least one fastener 46 is not visible when case 10 is in carrying mode.

Many features and components of rear panel 50 are similar to features and components of front panel 40. Rear panel 50 includes at least one fastener (not shown) secured to an outside surface 52 thereof and positioned adjacent to an inward end of the slot (not shown) of rear panel 50. Each fastener may be positioned an equal distance from top edge 51. Rear panel 50 further includes at least one fastener (not shown) secured to the outside surface 52 thereof and positioned adjacent to a side edge 55. Each fastener may be positioned an equal distance from side edge 55. Persons skilled in the art will recognize that any reasonable number of fasteners may be used to attach stool seat 30 to rear panel 50. Each fastener may be attached to rear panel 40 and/or formed integrally therewith. For example, each fastener may comprise snaps (i.e. press studs), Velcro™, buckles, hooks, toggles, keder rails, magnets, or other fastening devices conventionally known. In some embodiments, the at least one fastener adjacent to the inward end of the slot (not shown) of rear panel 50 is attached to or integrally formed with outside surface 52 of rear panel 50 and the at least one fastener adjacent to side edge 55 is attached to or integrally formed with an inside surface (not shown) of rear panel 50. In this way, the at least one fastener adjacent to side edge 55 is not visible when case 10 is in carrying mode.

Stool seat 30 comprises at least one fastener 34 adjacent to front end 31 and at least one fastener 38 adjacent to rear end 33. At least one fastener 34 and/or at least one fastener 38 may be attached to stool seat 30 and/or integrally formed therewith. At least one fastener 34 and/or at least one fastener 38 may comprise one or more of snaps (i.e. press studs), Velcro™, buckles, hooks, toggles, keder rails, magnets, or other fastening devices conventionally known.

In carrying mode, at least one fastener 34 adjacent to front end 31 of stool seat 30 engages at least one fastener 44 of front panel 40. At least one fastener 38 adjacent to rear end 33 of stool seat 30 engages the at least one rear fastener (not shown) of rear panel 50 adjacent to the inward end of the slot (not shown). In some embodiments, slot 48 of front panel 40 and/or the slot (not shown) of rear panel 50 is hidden by stool seat 30 when case 10 is in carrying mode.

Stool seat 30 is removably attachable to substructure 110 to form stool 100 by attaching front end 31 of stool seat 30 to front panel 40 via fasteners 34, 46, extending stool seat 30 over side edges 45, 55 of front and rear panels 40, 50, and attaching rear end 33 of stool seat 30 to rear panel 50 via at least one fastener 38 and the at least one rear panel fastener (not shown) of rear panel 50 adjacent to side edge 55.

Stool seat 30 comprises a flexible sheet material including one or more of fabric, leather, plastic, chain mail, and other flexible sheet materials conventionally known. In some embodiments, stool seat 30 may be articulated and/or include hinges to facilitate securing the front and rear panels 40, 50 to worktable 20, to facilitate removing the stool seat from case 10, and/or to facilitate forming a stool with front and rear panels 40, 50. For example, stool seat 30 may comprise hinged polypropylene or other hinged plastics.

Figure 3:
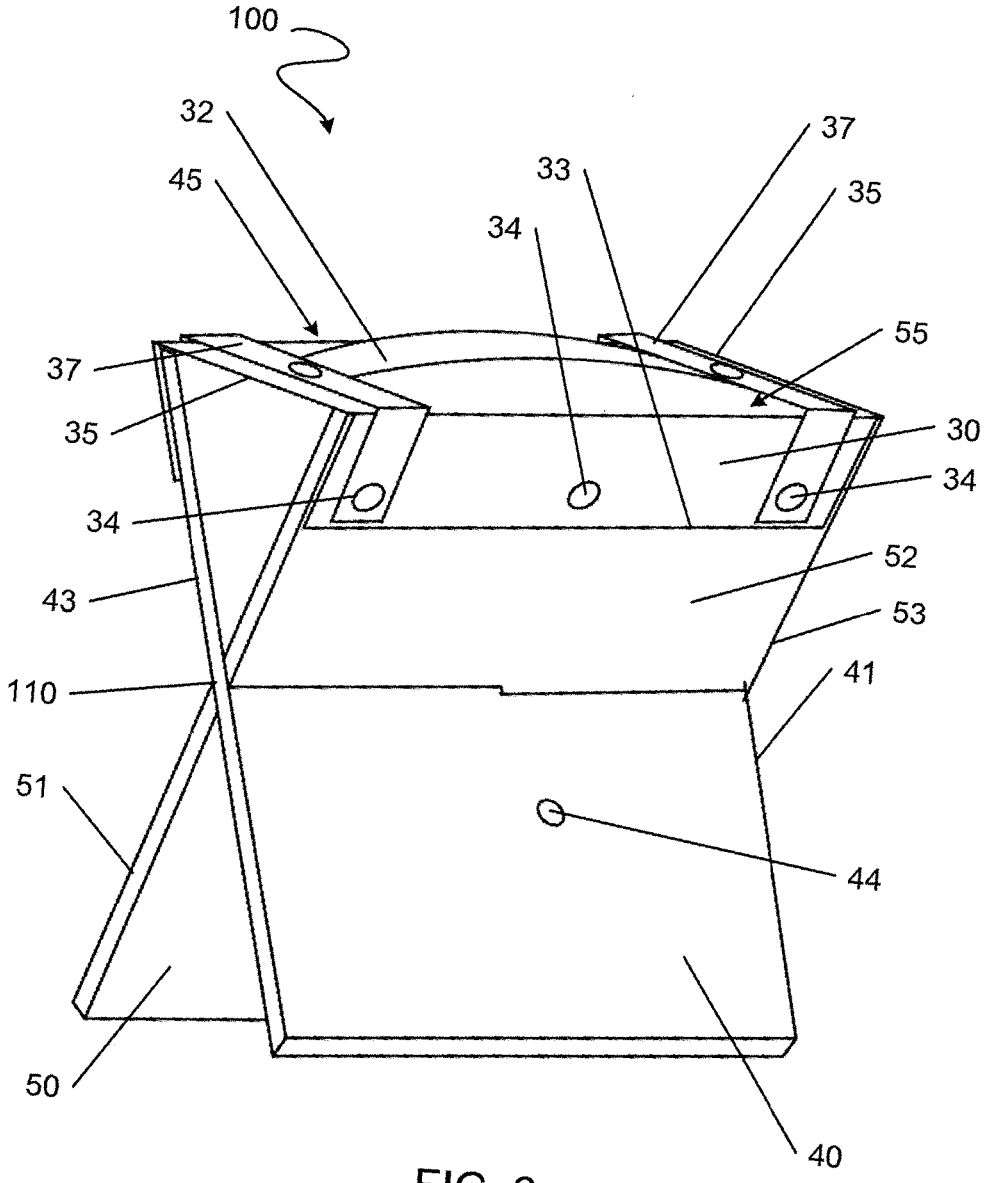
FIG. 3 is a perspective view of a stool according to an example embodiment of the present invention.
Figure 4:
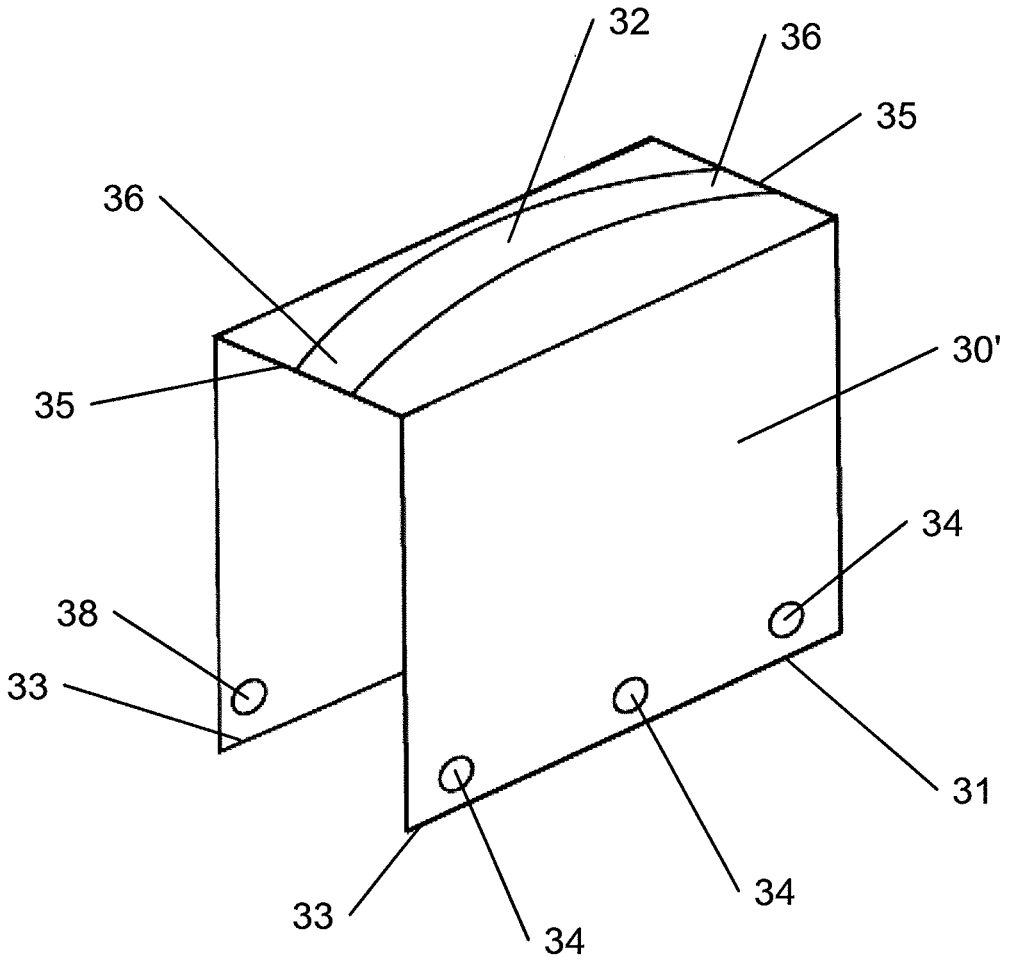
FIG. 4 is a perspective view of a stool seat according to an example embodiment of the present invention.

In the example embodiment shown in FIG. 3, stool seat 30 includes a pair of straps 37. Each strap 37 extends from front end 31 of stool seat 30 to rear end 33 along an opposed side end 35. Opposed ends 36 of handle 32 are each attached to a strap 37 midway between front and rear ends 31, 33. A stool seat 30' in accordance with another example embodiment of the present invention is shown in FIG. 4. Many features and components of stool seat 30' are similar to features and components of stool seat 30, with the same reference numerals being used to indicate features and components that are similar between the embodiments. Stool seat 30' lacks straps 37.

In some embodiments, a rigid C-shaped member (not shown) is snap fit over top surface 21 of worktable 20 to secure front and rear panels 40, 50 to worktable 20. The C-shaped member may be made of one or more of metal, wood, plastic, and other rigid materials conventionally known. In such embodiments, stool seat 30 is carried inside case 10 when the case is in carrying mode.

Figure 5:
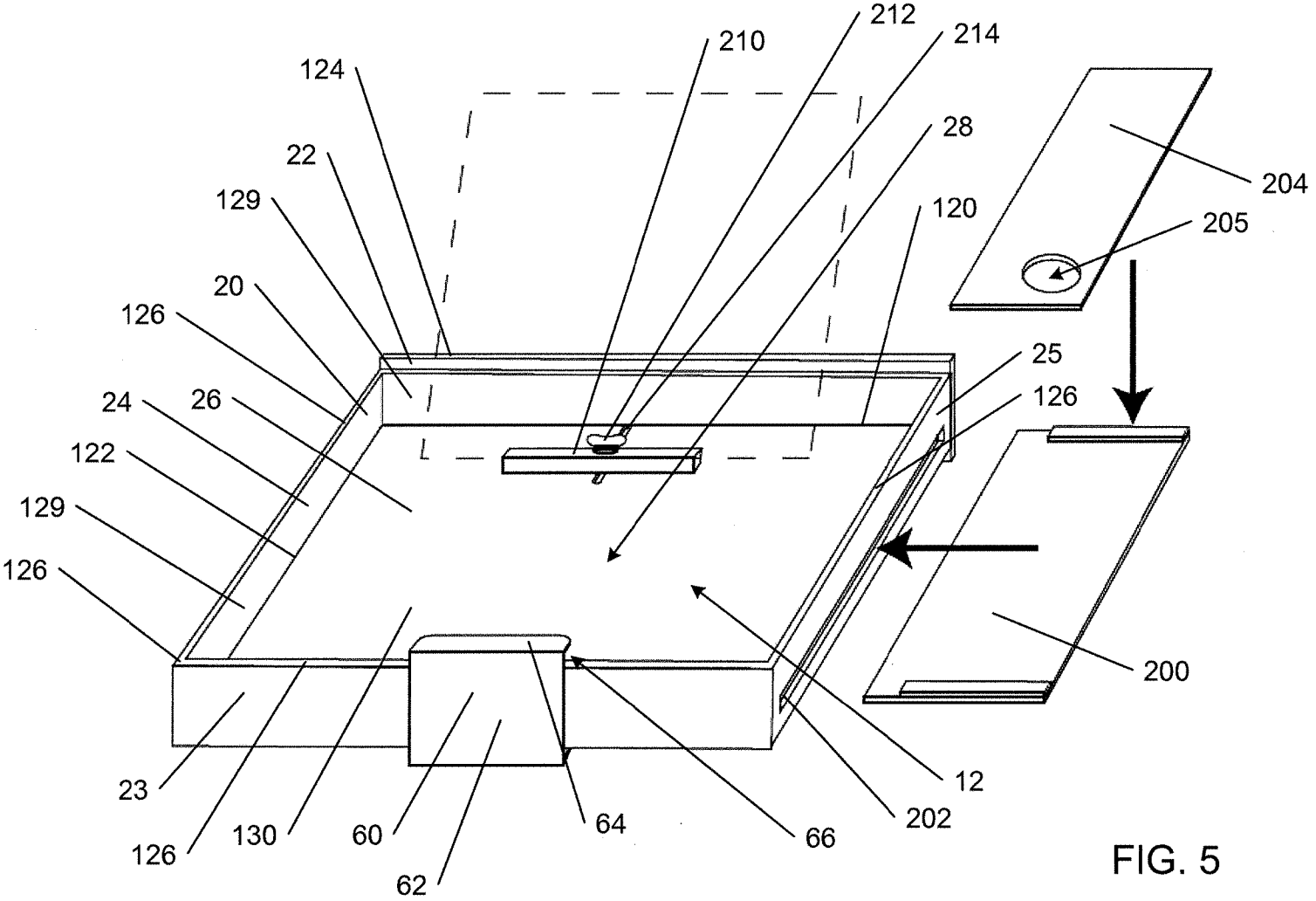
FIG. 5 is a perspective view of a worktable according to an example embodiment of the present invention.

Worktable 20 in accordance with one example embodiment of the present invention is shown in FIG. 5. Worktable 20 includes an inside panel 26, a top panel 22 secured to a top edge 120 of inside panel 26, bottom panel 23 secured to a bottom edge 121 of inside panel 26 (FIG. 2), and two opposed side panels 24, 25, each side panel secured to an opposed side edge 122 of inside panel 26. Inside surfaces 129 of panels 22, 23, 24, 25 and front surface 130 of inside panel 26 form a cavity 28 in a front side 12 of worktable 20 (FIGS. 2 and 5). Objects to be carried may be stored inside cavity 28 when case 10 is in carrying mode. Worktable 20 may additionally or alternatively define a cavity (not shown) in a rear side 14 of worktable 20. The depth of cavity 28 and/or the depth of the cavity in rear side 14 of worktable 20 may be modified based upon the needs of the user by modifying the position of inside panel 26 with respect to panels 22, 23, 24, 25. In some embodiments, worktable 20 is integrally formed.

In some embodiments, top panel 22 and/or bottom panel 23 may be sized to help secure front and rear panels 40, 50 to worktable 20 when case 10 is in carrying mode. For example, a front edge 124 of top panel 22 may extend outwardly from a front edge 126 of side panels 24, 25 and/or a rear edge 125 (FIG. 2) of top panel 22 may extend outwardly from a rear edge (not shown) of side panels 24, 25. Top panel 22 may thereby prevent front and rear panels 40, 50 from sliding upwardly or otherwise out of position when case 10 is in carrying mode. A front edge (not shown) of bottom panel 23 may extend outwardly from a front edge 126 of side panels 24, 25 and/or a rear edge (not shown) of bottom panel 23 may extend outwardly from a rear edge of side panels 24, 25. Bottom panel 23 may thereby prevent front and rear panels 40, 50 from sliding downwardly or otherwise out of position when case 10 is in carrying mode.

Case 10 may further include a retaining clip 60 for removably securing front and rear panels 40, 50 to worktable 20 when case 10 is in carrying mode. In some embodiments, retaining clip 60 is fixed to bottom panel 23 of worktable 20. In some other embodiments, retaining clip 60 is removably snap fit to case 10 or otherwise removably attached to case 10 using conventional means to secure front and rear panels 40, 50 to worktable 20 when case 10 is in carrying mode. Front panel 40 may include a notch 47 adjacent to a bottom edge 43 of front panel 40 for engaging retaining clip 60. Rear panel 50 may similarly include a notch (not shown) at a bottom edge 53 of rear panel 50 for engaging retaining clip 60.

Figure 6C:
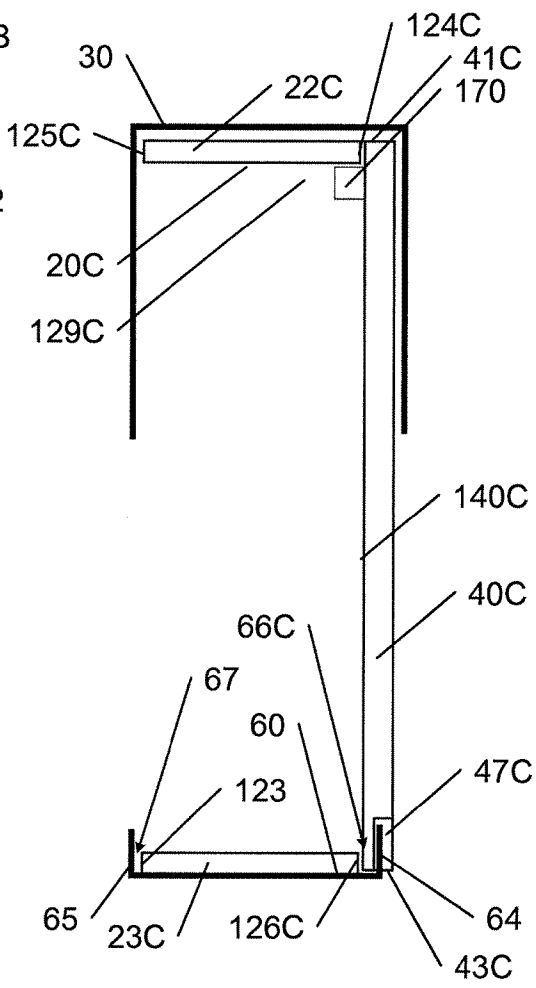
FIG. 6C is a side cross-section view of a partially disassembled convertible case according to an example embodiment of the present invention, wherein a front panel is removably attachable to a worktable via a wood strip fixed to an inside surface of the front panel.

Retaining clip 60 is C-shaped and includes a rigid body 62, an upwardly extending front edge 64, and an upwardly extending rear edge 65 (FIG. 6C). When retaining clip 60 is secured to bottom panel 23 of worktable 20, body 62 extends outwardly from front edge 126 of bottom panel 23 such that retaining clip 60 creates a channel 66 between front edge 64 and front edge 126 of bottom panel 23. Notch 47 of front panel 40 may be inserted into channel 66. Similarly, body 62 extends outwardly from rear edge 123 of bottom panel 23 such that retaining clip 60 creates a channel 67 between rear edge 65 of retaining clip 60 and rear edge 123 of bottom panel 23. The notch (not shown) of rear panel 50 may be inserted into channel 67.

Worktable 20, front panel 40, rear panel 50, and/or retaining clip 60 may each comprise one or more of wood, metal, fibre, thermoplastic, and thermosetting plastic. In some embodiments, worktable 20, front panel 40, rear panel 50, and/or retaining clip 60 may each be made of a molded thermoplastic or thermosetting plastic. For example, worktable 20, front panel 40, rear panel 50, and/or retaining clip 60 may each be made of a one-piece injection molded thermoplastic. In some embodiments, worktable 20, front panel 40, rear panel 50, and/or retaining clip 60 may be 3D printed. In some embodiments, worktable 20, front panel 40, rear panel 50, and/or retaining clip 60 may comprise die cast aluminum or other metal casting.

Case 10 optionally includes a removable shelf 200 and/or a bar 210 as shown in FIG. 5. Shelf 200 and/or bar 210 may be stored inside case 10 in carrying mode. When case 10 has been fully disassembled, shelf 200 may be inserted into a slot 202 formed in side panel 25 of worktable 20 to provide a user with an additional working surface. In some embodiments, shelf 200 includes a removable artist's palette 204 that may rest on shelf 200 or may be supported in the user's hand using thumb aperture 205. Shelf 200 comprises one or more of wood, metal, high density polyethylene, Plexiglas, and other plastics. Palette 204 comprises one or more of wood, metal, porcelain, Plexiglas, high density polyethylene, other plastics, and other hard, inert, nonporous materials conventionally known. Bar 210 may be secured to inside panel 26 of worktable 20 via a fastener 212 (for example, a wing nut). Bar 210 may be used to prop up paper or canvas board (shown in dotted lines in FIG. 5). In some embodiments, inside panel 26 includes a slot 214 inwardly extending from top edge 120. The position of bar 210 may be determined by fastening bar 210 to inside panel 26 at any position along slot 214. Bar 210 comprises one or more of wood, metal, high density polyethylene, and other plastics. Persons skilled in the art will recognize that shelf 200, palette 204, and bar 210 are geared towards artists; however, case 10 may be used by different types of users and/or for different purposes and may include other optional components that are geared towards the user and/or purpose. For example, case 10 may be designed for the needs of school children in developing countries who lack conventional school furniture. Such cases may include a worktable having a front and/or rear surface of the inside panel made of or painted with a blackboard material for writing with chalk. Case 10 may alternatively be designed to store a laptop for use by field engineers and/or other users operating in the outdoors or in remote areas. Case 10 may optionally include a shoulder strap (not shown) for carrying case 10 with comfort and convenience.

One or more of top panel 22, bottom panel 23, stool seat 30, and retaining clip 60 prevent front and rear panels 40, 50 from moving out of position when case 10 is in carrying mode. This may be achieved using a variety of means. For example, FIGS. 6A-6E and 7A-7B show alternate embodiments for removably securing panels 40, 50 to worktable 20. Persons skilled in the art will recognize that front panel 40 and/or rear panel 50 may be removably secured to worktable 20 using an assortment of means, including one or more of the example means shown in FIGS. 1, 6A-6E, and 7A-7B.

Figure 6B:
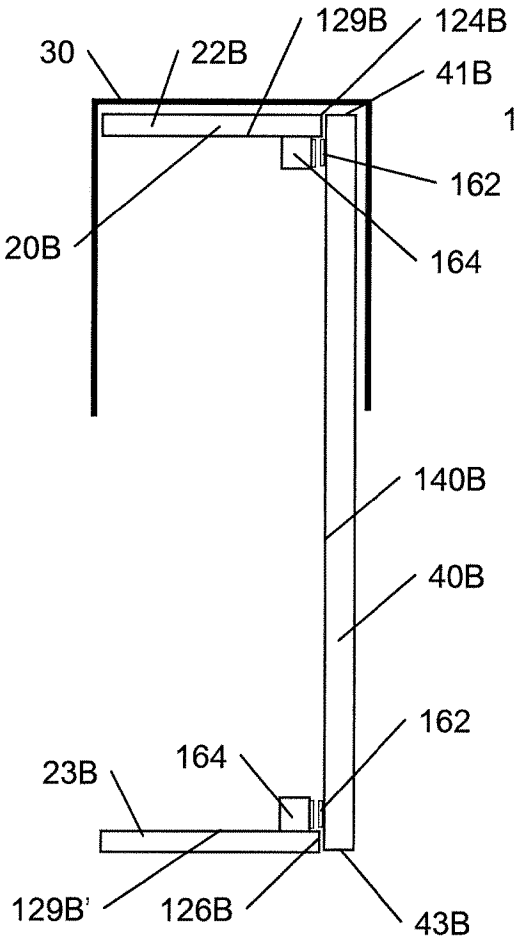
FIG. 6B is a side cross-section view of a partially disassembled convertible case according to an example embodiment of the present invention, wherein a front panel is removably attachable to a worktable via a hook and loop fastener such as Velcro™.
Figure 6A:
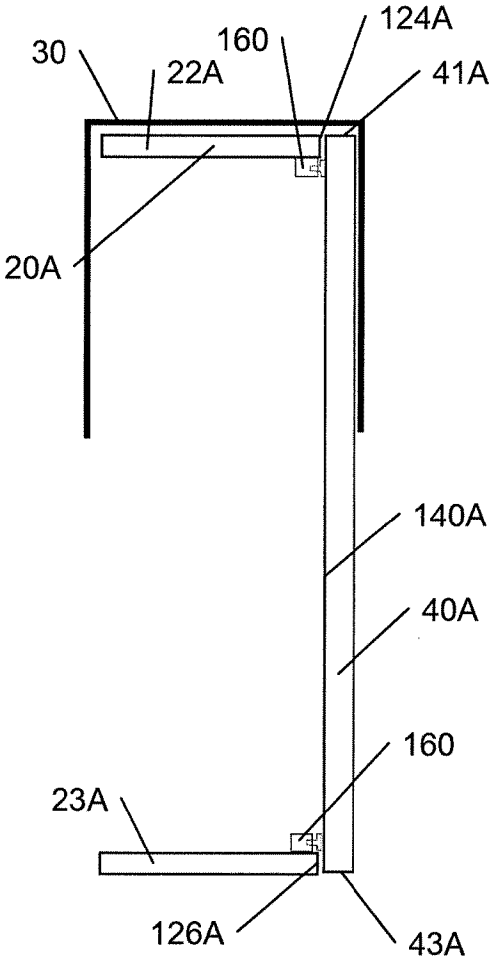
FIG. 6A is a side cross-section view of a partially disassembled convertible case according to an example embodiment of the present invention, wherein a front panel is removably attachable to a worktable via furniture snap fittings.

FIG. 6A shows a front panel 40A having a plurality of furniture snap fittings 160 attached to an inside surface 140A of front panel 40A. Furniture snap fittings 160 may be attached adjacent to a top edge 41A of front panel 40A and/or a bottom edge 43A of front panel 40A. Front panel 40A is removably snap fit to a worktable 20A by pressing inside surface 140A of front panel 40A against a front edge 124A of a top panel 22A and against a bottom edge 126A of a bottom panel 23A of worktable 20A. Persons skilled in the art will recognize that furniture snap fittings 160 may additionally or alternatively be attached to inside surface 140A of front panel 40A adjacent to one or more side edges (not shown) of front panel 40A. Persons skilled in the art will further recognize that furniture snap fittings 160 may additionally or alternatively be attached to top and/or bottom panels 22A, 23A and/or side panels (not shown) of worktable 20A to removably secure front panel 40A to worktable 20A. Persons skilled in the art will recognize that similar means may be used to secure the rear panel to worktable 20A. Persons skilled in the art will further recognize that furniture snap fittings 160 may be replaced with alternate securing means, such as magnets or a hook and loop fastener such as Velcro™ (FIG. 6B).

FIG. 6B shows a front panel 40B having at least one hook and loop fastener such as Velcro™ 162 attached to an inside surface 140B of front panel 40B. At least one Velcro™ 162 may be attached adjacent to a top edge 41B of front panel 40B and/or to a bottom edge 43B of front panel 40B. At least one hook and loop fastener such as Velcro™ 164 is attached to an inside surface 129B of a top panel 22B adjacent to a front edge 124B and/or to an inside surface 129B' of a bottom panel 23B adjacent to a front edge 126B of worktable 20B. In some to embodiments, at least one Velcro™ 164 is attached to front edge 124B of top panel 22B and/or to front edge 126B of bottom panel 23B. At least one Velcro™ 164 engages at least one Velcro™ 162. In some embodiments, at least one Velcro™ 162 comprises a strip of Velcro™ that extends along top edge 41B of front panel 40B and/or along bottom edge 43B of front panel 40B and/or at least one Velcro™ 164 comprises a strip of Velcro™ that extends adjacent to front edge 124B of top panel 22B and/or adjacent to front edge 126B of bottom panel 23B. Persons skilled in the art will recognize that at least one Velcro™ 162 may additionally or alternatively be attached to inside surface 140B of front panel 40B adjacent to one or more side edges (not shown) and/or at least one Velcro™ 164 may additionally or alternatively be attached to a front surface of the side panels (not shown) of worktable 20B. Front panel 40B is removably secured to worktable 20B by pressing inside surface 140B of front panel 40B against front edge 124B of top panel 22B and front edge 126B of bottom panel 23B. Persons skilled in the art will recognize that similar means may be used to secure the rear panel to worktable 20B.

FIG. 6C shows a front panel 40C having a strip of wood 170 attached to an inside surface 140C of front panel 40C. Wood strip 170 may be attached adjacent to a top edge 41C of front panel 40C (for example, ¼" from top edge 41C). Front panel 40C further includes a notch 47C at a bottom edge 43C for engaging retaining clip 60. Retaining clip 60 is attached to a bottom panel 23C of workstation 20C as described elsewhere herein. Front panel 40C is removably secured to worktable 20C by inserting notch 47C of front panel 40C into a channel 66C formed between front edge 64 of retaining clip 60 and a front edge 126C of bottom panel 23C of worktable 20C. Wood strip 170 frictionally engages an inside surface 129C of a top panel 22C of worktable 20C. Persons skilled in the art will recognize that one or more wood strips 170 may be used. In some embodiments, a single wood strip 170 extends along adjacent to top edge 41C of front panel 40C. Persons skilled in the art will recognize that similar means may be used to secure the rear panel to worktable 20C.

Figure 6E:
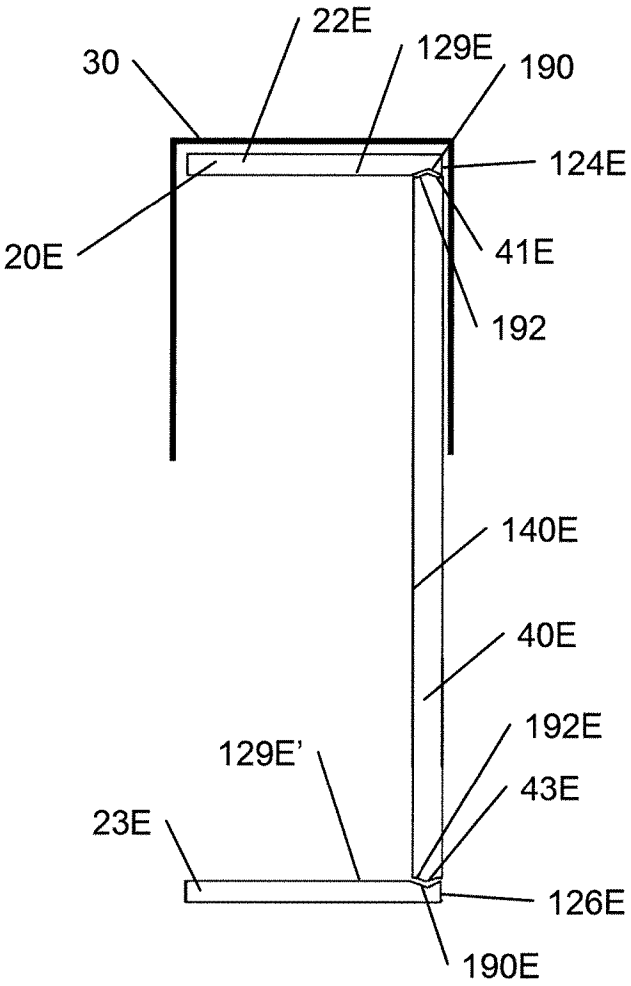
FIG. 6E is a side cross-section view of a partially disassembled convertible case according to an example embodiment of the present invention, wherein a front panel is removably snap fit to a worktable.
Figure 6D:
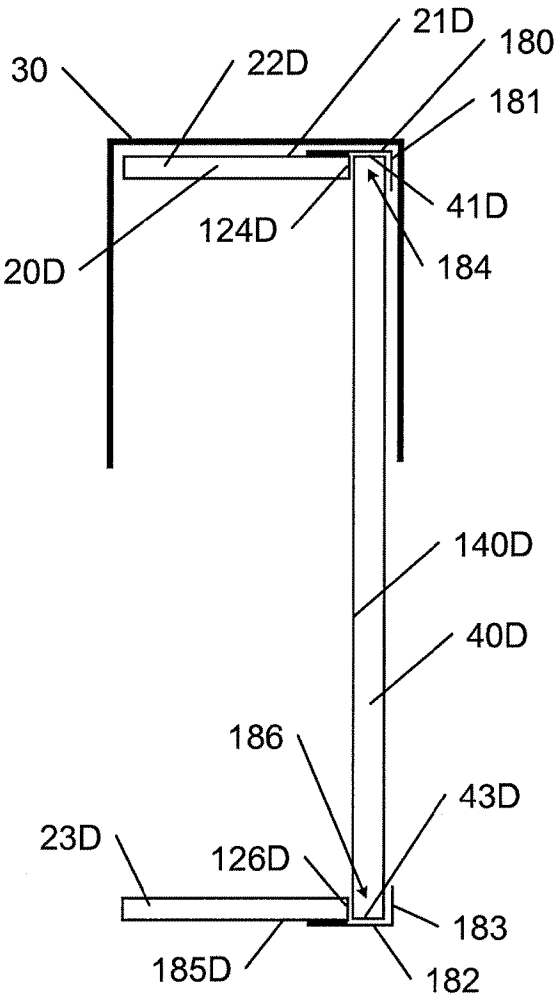
FIG. 6D is a side cross-section view of a partially disassembled convertible case according to an example embodiment of the present invention, wherein a front panel is removably attachable to a worktable via top and bottom brackets.

FIG. 6D shows a worktable 20D having a top bracket 180 secured to a top surface 21D of a top panel 22D of worktable 20D and a bottom bracket 182 secured to a, bottom surface 185D of bottom panel 23D of worktable 20D. Top and bottom brackets 180, 182 may be L-shaped and form channels 184, 186 between a front edge 181 of front bracket 180 and a front edge 124D of top panel 22D and between a front edge 183 of bottom bracket 182 and a front edge 126D of bottom panel 23D. One or more top bracket 180 and/or one or more bottom bracket 182 may be used. In some embodiments, top bracket 180 extends along front edge 124D of top panel 22D and/or bottom bracket 182 extends along front edge 126D of bottom panel 23D. Front panel 40D is removably secured to worktable 20D by simultaneously inserting a top edge 41D of front panel 40D through channel 184 and inserting a bottom edge 43D of front panel 40D through channel 186. Persons skilled in the art will recognize that similar means may be used to secure the rear panel to worktable 20D.

FIG. 6E shows a worktable 20E having at least one groove 190 in an inside surface 129E of a top panel 22E adjacent to a front edge 124E thereof and at least one groove 190E in an inside surface 129E' of a bottom panel 23E adjacent to a front edge 126E thereof. Front panel 40E includes at least one tongue 192 on a top edge 41E and at least one tongue 192E on a bottom edge 43E thereof. In some embodiments, groove 190 may extend along inside surface 129E of top panel 22E along front edge 124E and/or groove 190E may extend along inside surface 129E' of bottom panel 23E along front edge 126E. Tongue 192 may extend along top edge 41E of front panel 40E and/or tongue 192E may extend along bottom edge 43E of front panel 40E. Front panel 40E may be removably snap fit to worktable 20E by engaging at least one tongue 192 of front panel 40E with at least one groove 190 of worktable 20E and engaging at least one tongue 192E of front panel 40E with at least one groove 190E of worktable 20E. Persons skilled in the art will recognize that at least one tongue 192 and/or 192E of front panel 40E may be substituted with at least one groove and/or at least one groove 190 and/or 190E of worktable 20E may be substituted with at least one tongue. Persons skilled in the art will recognize that similar means may be used to secure the rear panel to worktable 20E.

In the example embodiments shown in FIGS. 6A-6B and 6D-6E, retaining clip 60 is not required to removably secure the front and rear panels to the worktable.

Figure 7A:
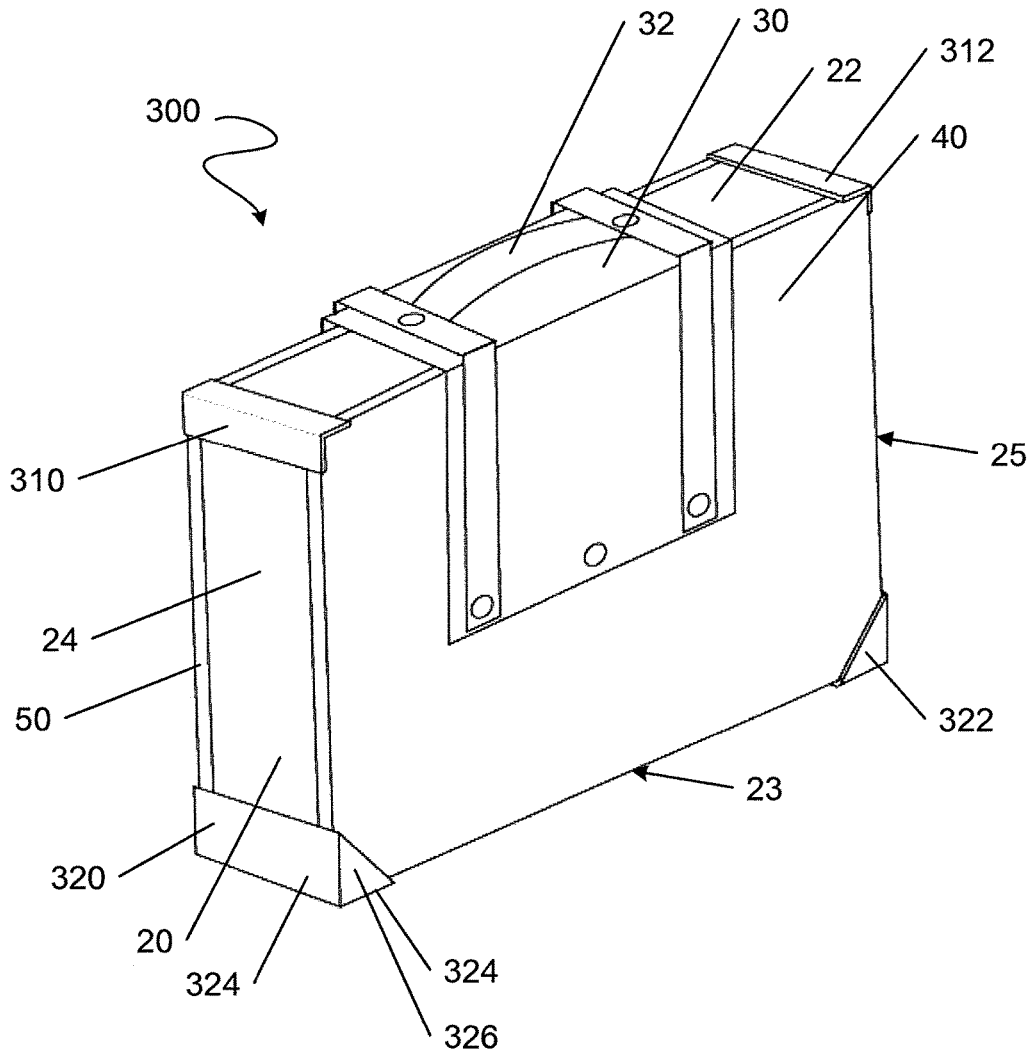
FIG. 7A is a perspective view of a convertible case according to an example embodiment of the present invention.

FIG. 7A shows a convertible case 300 in accordance with one example embodiment of the present invention. Many features and components of case 300 are similar to features and components of case 10, with the same reference numerals being used to indicate features and components that are similar between the embodiments. To retain front and rear panels 40, 50 in position when case 300 is in carrying mode, case 300 includes top retaining clips 310, 312 and bottom retaining clips 320, 322. Top retaining clips 310, 312 are L-shaped and fit about the corners formed by top panel 22 and side panels 24, 25. In some embodiments, front edge 124 (FIG. 2) of top panel 22 and front edge 126 of side panels 24, 25 are coplanar and/or rear edge 125 of top panel 22 and the rear edge (not shown) of side panels 24, 25 are coplanar. In such embodiments, top retaining clips 310, 312 extend outwardly from the front edge and/or the rear edge of top panel 22 and side panels 24, 25 such that top retaining clips 310, 312 prevent front panel 40 and/or rear panel 50 from moving out of position (i.e. upwards or sideways) when case 300 is in carrying mode. In some other embodiments, front edge 124 of top panel 22 may extend outwardly from front edge 126 of side panels 24, 25 and/or rear edge 125 of top panel 22 may extend outwardly from the rear edge (not shown) of side panels 24, 25 to prevent front panel 40 and/or rear panel 50 from moving upwards when case 300 is in carrying mode. In such embodiments, top retaining clips 310, 312 may not extend beyond front edge 124 and/or rear edge 125 of top panel 22.

Bottom retaining clips 320, 322 are shaped to fit about the corners formed by bottom panel 23 and side panels 24, 25. Bottom retaining clip 320 comprises an L-shaped member 324, a front panel retaining member 326 at a front end of L-shaped member 324, and a rear panel retaining member (not shown) at a rear end of L-shaped member 324. Many features and components of bottom retaining clip 322 are similar to features and components of bottom retaining clip 320. In some embodiments, the front edge of bottom panel 23 and the front edge of side panels 24, 25 are coplanar and/or the rear edge of bottom panel 23 and the rear edge of side panels 24, 25 are coplanar. In such embodiments, bottom retaining clips 320, 322 extend outwardly from the front edge and/or the rear edge of bottom panel 23 and side panels 24, 25 such that bottom retaining clips 320, 322 prevent front panel 40 and/or rear panel 50 from moving out of position (i.e. downwards or sideways) when case 300 is in carrying mode. In some other embodiments, the front edge of bottom panel 23 may extend outwardly from the front edge of side panels 24, 25 and/or the rear edges of bottom panel 23 may extend outwardly from the rear edges of side panels 24, 25 to prevent front panel 40 and/or rear panel 50 from moving downwards when case 300 is in carrying mode. In such embodiments, bottom retaining clips 320, 322 may not extend beyond the front edge and/or the rear edge of bottom panel 23.

Figure 7B:
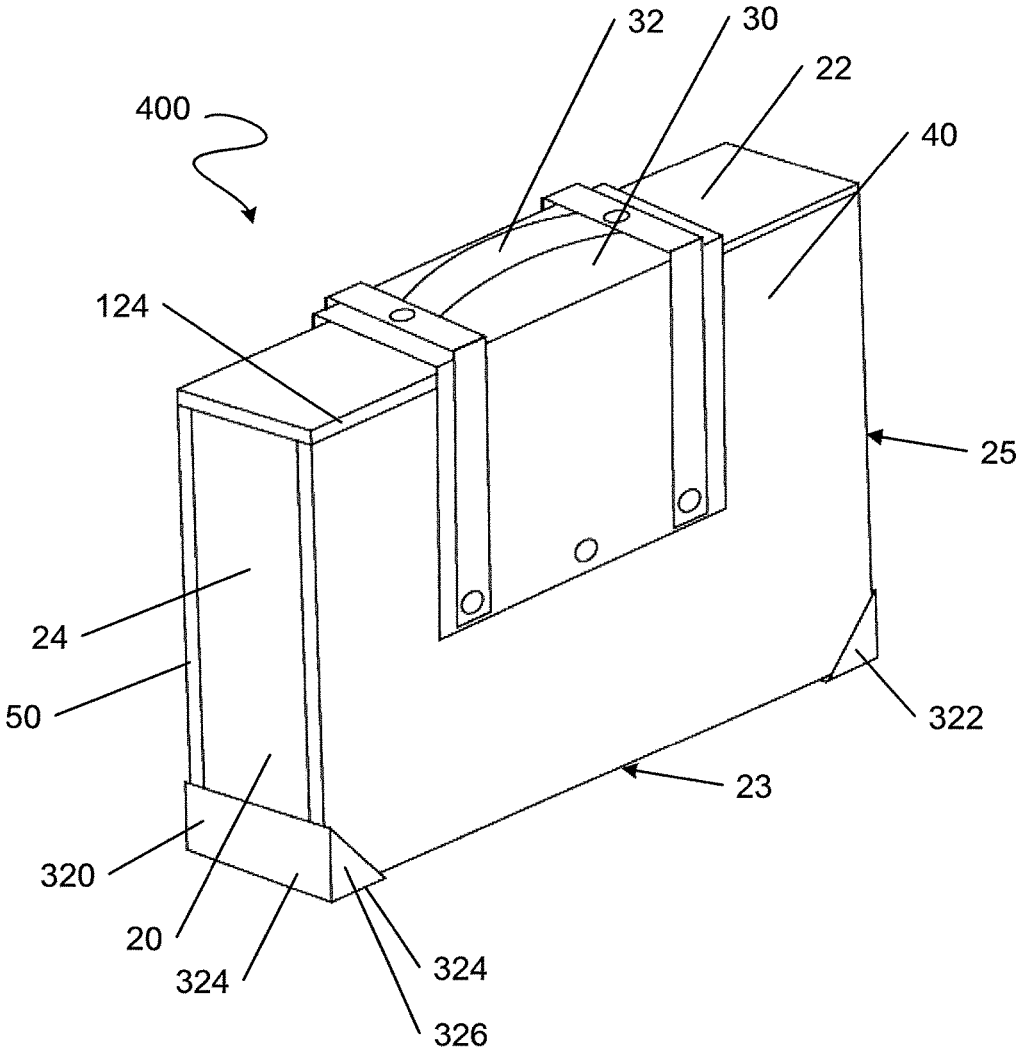
FIG. 7B is a perspective view of a convertible case according to an example embodiment of the present invention.

FIG. 7B shows a convertible case 400 in accordance with one example embodiment of the present invention. Many features and components of case 400 are similar to features and components of case 300, with the same reference numerals being used to indicate features and components that are similar between the embodiments. To prevent front panel 40 and/or rear panel 50 from moving upwards when case 400 is in carrying mode, the front edge 124 of top panel 22 extends outwardly from the front edges 126 of side panels 24, 25 and the rear edge 125 of top panel 22 extends outwardly from the rear edges (not shown) of side panels 24, 25.

Figure 8A:
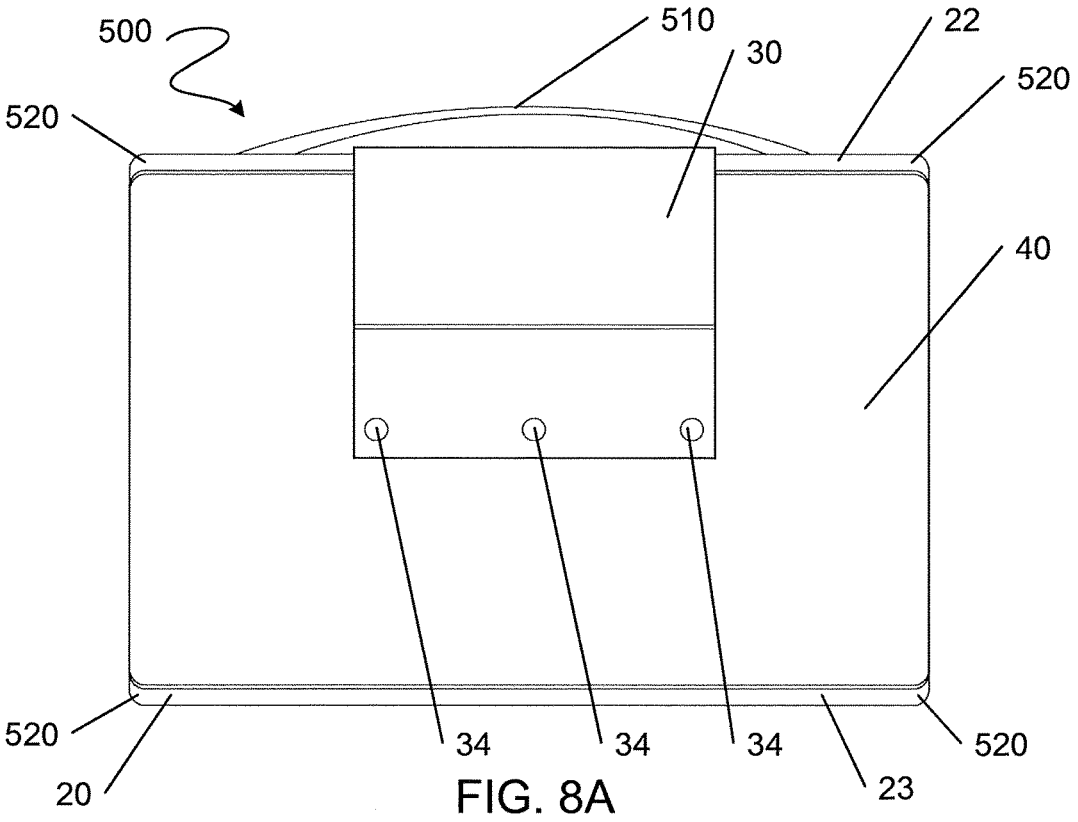
FIG. 8A is a front elevation view of a convertible case according to an example embodiment of the present invention.
Figure 8B:
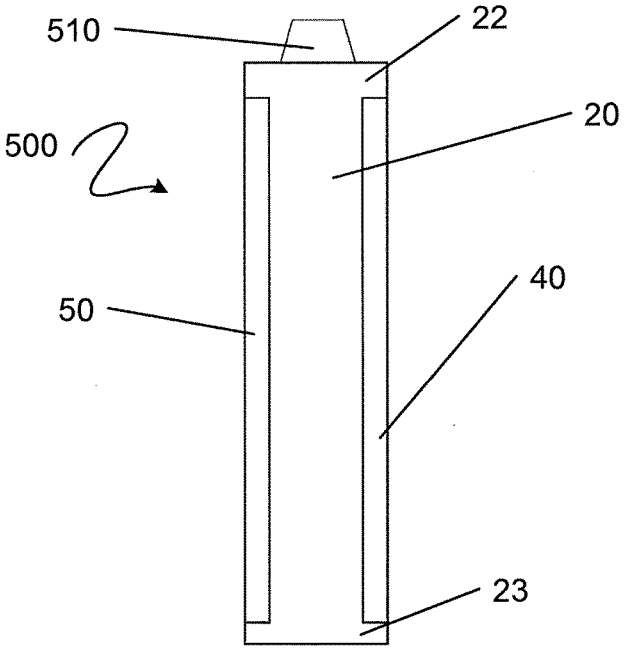
FIG. 8B is a side elevation view of the convertible case according to the example embodiment shown in FIG. 8A.
Figure 9:
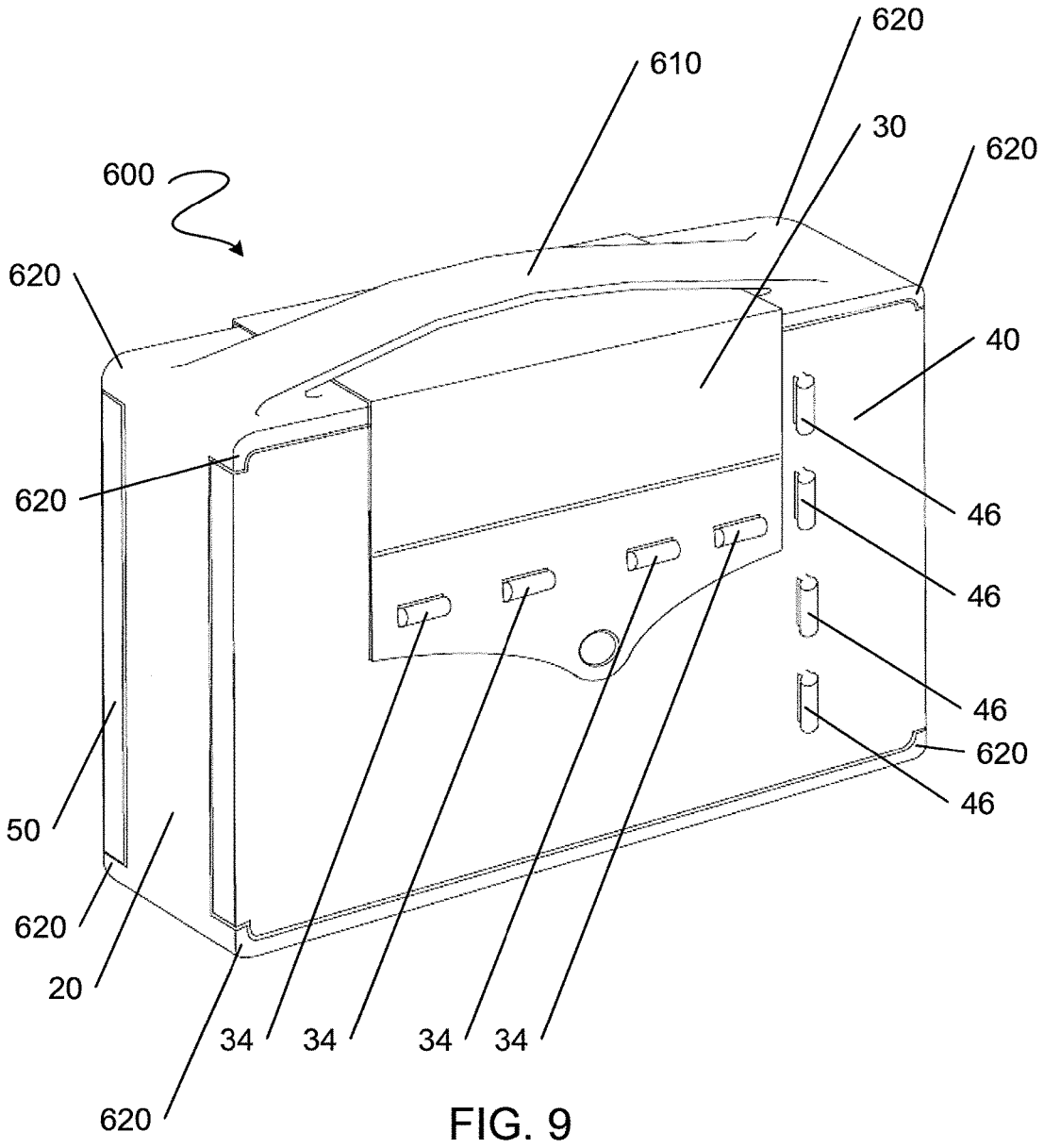
FIG. 9 is a perspective view of a convertible case according to an example embodiment of the present invention.

FIGS. 8A-8B show a convertible case 500 in accordance with one example embodiment of the present invention. Many features and components of case 500 are similar to features and components of case 10, with the same reference numerals being used to indicate features and components that are similar between the embodiments. Worktable 20, stool seat 30, front panel 40, and rear panel 50 are each made of a molded thermoplastic or thermosetting plastic. For example, worktable 20, stool seat 30, front panel 40, and rear panel 50 may each be made of a one-piece injection molded thermoplastic. Worktable 20 is integrally formed and includes an integral handle 510. Front panel 40 and rear panel 50 are snap fit to worktable 20 using a tongue and groove fastening means, such as the fastening means shown in FIG. 6E. As best seen in FIG. 8A, top panel 22 and/or bottom panel 23 of worktable 20 include rounded corners 520 to prevent front panel 40 and rear panel 50 from moving out of position when case 500 is in carrying mode. Persons skilled in the art will recognize that front panel 40 and/or rear panel 50 may be secured to worktable 20 using other fastening means conventionally known and/or described elsewhere herein.

FIG. 9 shows a convertible case 600 in accordance with one example embodiment of the present invention. Many features and components of case 600 are similar to features and components of case 10, with the same reference numerals being used to indicate features and components that are similar between the embodiments. Worktable 20, stool seat 30, front panel 40, and rear panel 50 are each made of a molded thermoplastic or thermosetting plastic. For example, worktable 20, stool seat 30, front panel 40, and rear panel 50 may each be made of a one-piece injection molded thermoplastic. Worktable 20 is integrally formed and includes an integral handle 610. The fasteners of stool seat 30, front panel 40, and rear panel 50, described elsewhere herein, are integrally formed therewith. For example, fasteners 46 are integrally formed with front panel 40. Fasteners 34 are integrally formed with stool seat 30. Front panel 40 and rear panel 50 are snap fit to worktable 20 using a tongue and groove fastening means, such as the fastening means shown in FIG. 6E. To prevent front panel 40 and rear panel 50 from moving out of position when case 600 is in carrying mode top panel 22 and/or bottom panel 23 of worktable 20 include rounded corners 520. Persons skilled in the art will recognize that front panel 40 and/or rear panel 50 may be secured to worktable 20 using other fastening means conventionally known and/or described elsewhere herein.

Interpretation of Terms

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to";
- "connected", "coupled", or any variant thereof, means any connection or coupling, either direct or indirect, between two or more elements; the coupling or connection between the elements can be physical, logical, or a combination thereof;
- "herein", "above", "below", and words of similar import, when used to describe this specification, shall refer to this specification as a whole, and not to any particular portions of this specification;
- "or", in reference to a list of two or more items, covers all of the following interpretations of the word: any of the items in the list, all of the items in the list, and any combination of the items in the list;
- the singular forms "a", "an", and "the" also include the meaning of any appropriate plural forms.

Words that indicate directions such as "vertical", "transverse", "horizontal", "upward", "downward", "forward", "backward", "inward", "outward", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

Where a component (e.g. a substrate, assembly, device, manifold, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments described herein.

Specific examples of systems, methods, and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

What is claimed is:

1. A case convertible into a stool and a working surface, the case comprising:

a worktable;

a front panel removably secured to a front side of the worktable;

a rear panel removably secured to a rear side of the worktable; and a stool seat configured to secure the front and rear panels to the worktable in a carrying mode wherein the case is fully assembled, wherein in a working mode the case is fully disassembled and the front and rear panels are removed from the worktable and interconnected to form a supporting substructure of the stool and the stool seat is removably extended from the first panel of the supporting substructure to the second panel of the supporting substructure to define a sitting surface.

2. A case according to claim 1, wherein the front and rear panels each comprise a slot inwardly extending from a first edge thereof, wherein the front and rear panels are interconnected by sliding the slot of the front panel through the slot of the rear panel.

3. A case according to claim 1, wherein the stool seat comprises a front end removably attachable to the front panel and a rear end removably attachable to the rear panel.

4. A case according to claim 3, wherein the stool seat comprises at least one front end fastener positioned adjacent to the front end and at least one rear end fastener positioned adjacent to the rear end.

5. A case according to claim 4, wherein the front and rear panels each comprise at least one case fastener secured to a first surface thereof and positioned adjacent to an inward end of the slot, the at least one case fastener of the front panel for engaging the at least one front end fastener of the stool seat and the at least one case fastener of the rear panel for engaging the at least one rear end fastener of the stool seat when the front and rear panels are removably secured to the worktable.

6. A case according to claim 1, wherein the stool seat extends across a top surface of the worktable when the front and rear panels are removably secured to the worktable.

7. A case according to claim 4, wherein the front and rear panels each comprise at least one stool fastener secured to the first surface thereof and positioned adjacent to a second edge that is parallel to the slot, the at least one stool fastener of the front panel for engaging the at least one front end fastener of the stool seat and the at least one stool fastener of the rear panel for engaging the at least one rear end fastener of the stool seat when the front and rear panels are interconnected to form the substructure of the stool.

8. A case according to claim 7, wherein the front and rear panels each comprise at least one case fastener secured to a first surface thereof and positioned adjacent to an inward end of the slot, the at least one case fastener of the front panel for engaging the at least one front end fastener of the stool seat and the at least one case fastener of the rear panel for engaging the at least one rear end fastener of the stool seat when the front and rear panels are removably secured to the worktable.

9. A case according to claim 6, wherein the stool seat includes a handle.

10. A case according to claim 1, wherein the stool seat comprises a flexible sheet material.

11. A case according to claim 1, wherein the stool seat comprises a hinged or an articulated rigid material.

12. A case according to claim 1, further comprising at least one retaining clip attached to a bottom surface of the worktable for removably securing the front and rear panels to the worktable.

13. A case according to claim 12, wherein the front and rear panels each comprise a notch adjacent to a third edge thereof for engaging the at least one retaining clip.

14. A case according to claim 1, wherein the front and rear panels each comprise at least one worktable fastener for removably securing the front and rear panels to the worktable.

15. A case according to claim 1, wherein the worktable comprises at least one panel fastener for removably securing the front and rear panels to the worktable.

16. A case convertible into a stool and a working surface, the case comprising:

a worktable comprising:

an inside panel;

a top panel secured to a top edge of the inside panel;

a bottom panel secured to a bottom edge of the inside panel opposed to the top edge;

a first side panel secured to a first side edge of the inside panel; and a second side panel secured to a second side edge of the inside panel opposed to the first side edge a front panel removably secured to a front side of the worktable;

a rear panel removably secured to a rear side of the worktable; and a stool seat, wherein the front and rear panels are interconnectable to form a supporting substructure of the stool and the stool seat is removably attachable to the substructure.

17. A case according to claim 16, wherein an inside surface of each of the top panel, the bottom panel, the first side panel, and the second side panel and a first surface of the inside panel form a first cavity.

18. A case according to claim 16, wherein the inside surface of each of the top panel, the bottom panel, the first side panel, and the second side panel and a second surface of the inside panel form a second cavity.

19. A case according to claim 16, wherein the worktable is integrally formed.

20. A case according to claim 16, wherein a front edge of the top panel extends outwardly from a front edge of the side panels and a rear edge of the top panel extends outwardly from a rear edge of the side panels.

21. A case according to claim 20, wherein opposed edges of the front and rear panels each comprise at least one tongue and an inside surface of each the top and bottom panels of the worktable each comprise at least one groove adjacent to both of the front and rear edges thereof, wherein the at least one tongue of the front panel matingly engages the at least one groove of the top and bottom panels of the worktable adjacent to the front edge and the at least one tongue of the rear panel matingly engages the at least one groove of the top and bottom panels of the worktable adjacent to the rear edge.

22. A case according to claim 20, wherein opposed edges of the front and rear panels each comprise at least one groove and an inside surface of each the top and bottom panels of the worktable each comprise at least one tongue adjacent to both of the front and rear edges thereof, wherein the at least one groove of the front panel matingly engages the at least one tongue of the top and bottom panels of the worktable adjacent to the front edge and the at least one groove of the rear panel matingly engages the at least one tongue of the top and bottom panels of the worktable adjacent to the rear edge.

* * * * *